US006192791B1

(12) United States Patent
Baker et al.

(10) Patent No.: US 6,192,791 B1
(45) Date of Patent: Feb. 27, 2001

(54) BOILING SINK COOKING SYSTEM FOR A KITCHEN

(75) Inventors: Sage N. Baker, San Diego, CA (US); Simon Potter, Boston, MA (US); Jody D. Goodman, Tokyo (JP); Michael T. Cattaui, Trelex (CH); Jeremy C. Howard, Little Compton, RI (US); Luke W. Michas, North Providence, RI (US); Michael T. Lye, Warwick, RI (US); Marc S. Harrison, deceased, late of Portmouth, RI (US), by Diana Harrison, executrix; Jane K. Langmuir, Providence, RI (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/440,124

(22) Filed: Nov. 15, 1999

(51) Int. Cl.[7] ..... A47J 27/00; A47J 37/12
(52) U.S. Cl. ..... 99/403; 99/330; 99/407
(58) Field of Search ..... 99/403, 407, 410, 99/330; 219/432, 428, 429

(56) References Cited

U.S. PATENT DOCUMENTS

| | | | | |
|---|---|---|---|---|
| 1,999,231 | | 4/1935 | Davock . | |
| 2,978,975 | * | 4/1961 | Rossi | 99/403 X |
| 3,626,840 | * | 12/1971 | Day | 99/403 X |
| 3,958,503 | | 5/1976 | Moore | 99/327 |
| 3,964,637 | * | 6/1976 | Luebke et al. | 99/403 X |
| 4,574,688 | | 3/1986 | Barbieri | 99/330 |
| 4,668,390 | | 5/1987 | Hurley et al. | 210/167 |
| 4,684,412 | | 8/1987 | Fritzsche | 134/19 |
| 4,741,261 | * | 5/1988 | DiMaria | 99/403 X |
| 5,103,801 | | 4/1992 | Herring et al. | 126/374 |
| 5,385,084 | | 1/1995 | Laibson | 99/411 |
| 5,609,093 | | 3/1997 | Hohler et al. | 99/408 |
| 5,758,572 | * | 6/1998 | Hennessy et al. | 99/403 X |

* cited by examiner

*Primary Examiner*—Reginald L. Alexander
(74) *Attorney, Agent, or Firm*—Everett G. Diederiks, Jr.

(57) ABSTRACT

A cooking system includes a sink having a basin recessed within a kitchen countertop. The sink is provided with a water inlet, a water outlet and an energy source for heating water introduced into the basin. The cooking system also includes a container that preferably has bottom and side wall portions provided with a plurality of through holes. The container is adapted to house food and to be positioned within the heated water of the basin in order to enable the food items in the container to be cooked.

20 Claims, 2 Drawing Sheets

BOILING SINK COOKING SYSTEM FOR A KITCHEN

BACKGROUND OF THE INVENTION

1. Field of the Invention

The present invention pertains to the art of cooking and, more particularly, to the incorporation of a boiling sink and matching basket system in a kitchen.

2. Discussion of the Prior Art

Modern day kitchens, in both commercial and residential settings, are typically provided with various different cooking appliances that can be used individually or in combination to perform a wide range of cooking operations. Some of these cooking operations are performed in boiling water. For instance, poultry, shrimp, eggs, pasta and vegetables are often cooked in boiling water. Although some of these cooking operations can be performed in a microwave oven, most commonly a pot is filled with water and heated upon a surface element of a cooktop in order to boil water for such cooking operations. Obviously, the use of a surface element to perform this operation makes this surface element unavailable for another cooking operation to be preformed at the same time.

There is also a tendency to provide certain cooking units which have dedicated functions. For instance, steamers and deep-fry cookers are fairly popular cooking appliances. Such type of appliances generally enable a single type of cooking operation to be performed on a variety of different food items. However, providing individualized appliances for various different cooking operations would be quite cumbersome. Therefore, there is considered a need in the art for a cooking appliance dedicated for use in cooking food items which need to be boiled in water, but wherein the appliance is integrated into a kitchen countertop.

SUMMARY OF THE INVENTION

The present invention is directed to a kitchen cooking system including a sink having a basin which is recessed within an elongated work surface of a countertop. The sink includes a water inlet opening into the basin at a level below the work surface for supplying water into the basin. An outlet is also provided in the sink for draining the water. Around a body portion of the basin is arranged an energy source that can be activated to boil water supplied into the basin.

Also provided in accordance with the invention is a cooking container including a main body which is preferably shaped to conform to the basin. The container is adapted to hold food items to be cooked in the boiling water of the basin. In the most preferred form of the invention, the container constitutes a colander having bottom and side wall portions provided with a plurality of spaced through holes. The colander includes an elongated handle which projects along the countertop to enable the container and food items to be readily removed from the sink following the completion of the cooking operation.

With this arrangement, water directly enters the basin from the internal water inlet in order to avoid any spillage on the countertop. The energy source is then activated to heat the water, preferably to a boiling point. Food items, such as pasta or vegetables, can be placed in the container and then submerged in the water boiling in the basin. In this manner, the food items can be cooked. After a prescribed cooking operation has been completed, the container can simply be lifted out of the basin, with any water dripping from the food items being simply caught in the sink. Thereafter, the cooked food items can be directly transferred to another serving container, platter or the like. Once the cooking operation is complete, the water can be readily drained from the sink in preparation for a subsequent cooking operation.

DETAILED DESCRIPTION OF A PREFERRED EMBODIMENT

Figure 1:
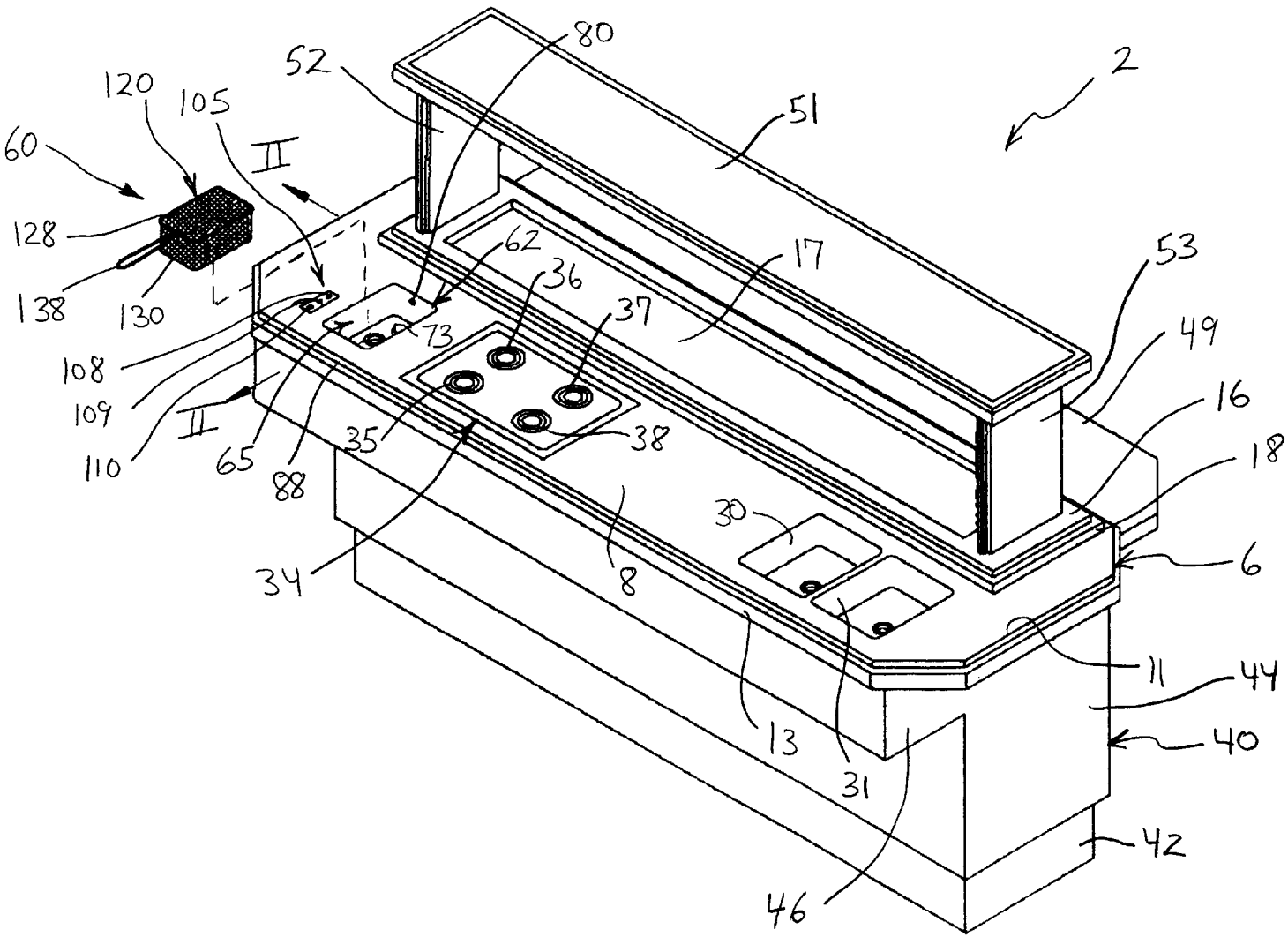
FIG. 1 is an upper perspective view of a kitchen island incorporating the cooking system of the present invention.

With initial reference to FIG. 1, a workstation for a cooking environment that is generally illustrated to take the form of a kitchen island is indicated at 2. Island 2 includes an overall countertop 6 having a work surface 8 that is preferably provided with a peripheral lip 11. Also located around first work surface 8, at a position slightly outwardly and below lip 11, is railing trim 13. As shown, countertop 6 also includes a raised platform 16 having a central zone 17 and an associated, intermediate tier 18. In the embodiment shown, island 2 is provided with a pair of spaced sinks 30 and 31, as well as a cooking appliance shown in the form of an electric cooktop 34. For the sake of simplicity of the drawings, a faucet for sinks 30 and 31, as well as controls for cooktop 34 have not been illustrated. However, cooktop 34 is shown to include multiple, spaced heating elements 35–38. Although the structure and arrangement of cooktop 34 is not considered part of the present invention, cooktop 34 preferably defines a substantially smooth working surface across countertop 6.

Countertop 6 is shown to be supported by a base 40 having a lowermost section 42 and an upper section 44 that includes an outwardly extending portion 46. Therefore, upper section 44, with outwardly extending portion 46, supports countertop 6 such that first work surface 8 extends in a substantially horizontal plane. At this point, it should be noted that outwardly extending portion 46 need not extend entirely across the longitudinal side of countertop 6 but could simply be constituted by various spaced, cantilevered beams if enhanced leg room or the like is desirable under countertop 6. In any event, upper section 44 of base 40 is further used to support a table 49 that is adapted to be used in connection with chairs or the like as a small breakfast or other eating area while the portion of countertop 6 located on the opposite side of platform 16 from table 49 would generally be located in the kitchen area. Again, this arrangement is merely presented in accordance with the preferred embodiment of the invention and for the sake of completeness. For the same reason, island 2 is shown to include an upper tabletop 51 that is spaced above platform 16 by means of pillars 52 and 53.

The present invention is particularly directed to a cooking system 60 that includes a boiling sink 62. More specifically, sink 62 includes a basin 65 defined by a floor portion 68 and side walls 70–73 as collectively shown in FIGS. 1 and 2. Side walls 70–73 terminate in an upper rim zone 76 of basin 65. In the most preferred form of the invention, basin 65 is integrated into countertop 6. For instance, countertop 6 can be made of Corian, marble, granite or the like, and is integrally formed with basin 65. On the other hand, sink 62 can be defined by an insert for countertop 6. In either case, basin 65 is recessed within countertop 6 below work surface 8.

Sink 62 incorporates a water inlet 80 that is shown to be provided in side wall 72. In the most preferred embodiment, water inlet 80 is located directly below upper rim zone 76. Water inlet 80 has attached thereto a water pipe 82. Pipe 82 can essentially be constituted by a hot water pipe or it can be a common outlet pipe for a controlled flow of hot and cold water in a manner analogous to the faucet of a conventional sink. In any event, the manner in which water is supplied to pipe 82 will be described more fully below. Basin 65 is also provided with a water outlet 86 that has an associated drain pipe 88. Drain pipe 88 is preferably connected to a common drain with sinks 30 and 31. However, a dedicated drain could be equally provided. Regardless, basin 65 can be filled with water from pipe 82 and can also be selectively drained through water outlet 86.

Figure 2:
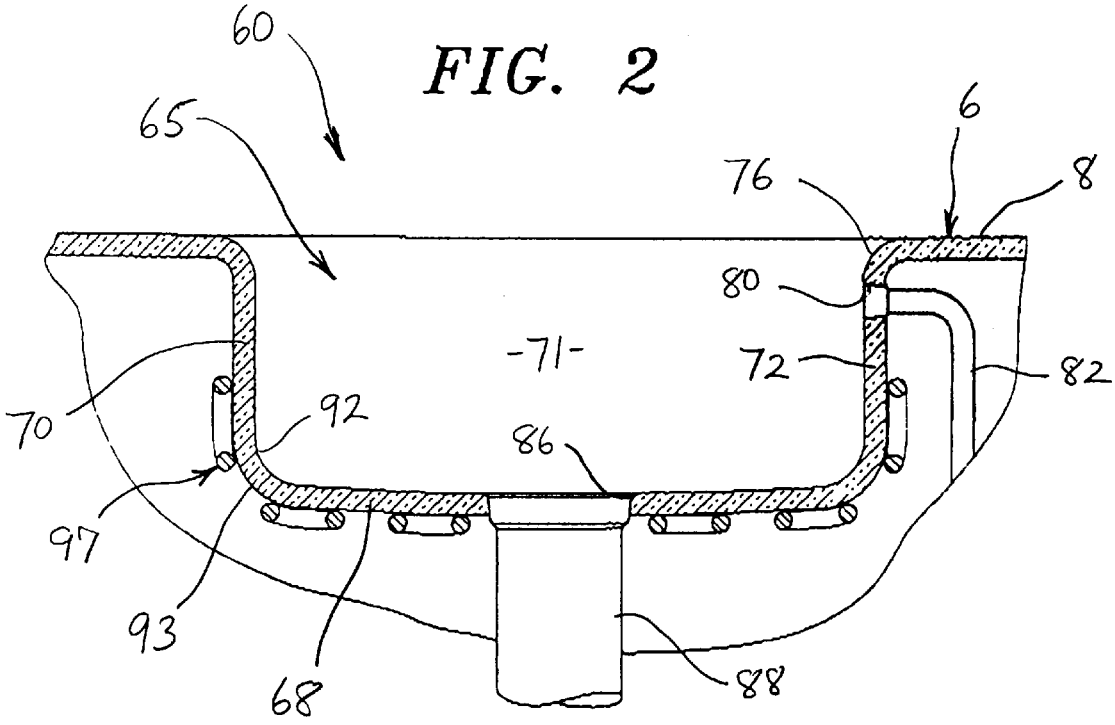
FIG. 2 is a partial cross-sectional view generally taken along line II—II of FIG. 1.

As clearly shown in FIG. 2, basin 65 includes an inner surface 92 and an outer surface 93. Extending across floor 68 and portions of side walls 70–73 in accordance with the invention is an energy source 97. In the most preferred form of the invention, energy source 97 takes the form of an electric resistance heating element that extends around basin 65 in a generally serpentine path. Energy source 97 is provided for the purpose of boiling water introduced into basin 65 through inlet 80. At this point, it should be recognized that various types of energy sources could be equally utilized in accordance with the invention.

Although manual controls could be provided to selectively introduce water into basin 65 in a manner similar to that of a conventional faucet and a simply plug or the like could be associated with water outlet 86, in the preferred form of the invention, these functions are performed electronically through a control panel 105. More specifically, in the exemplary embodiment, control panel 105 is shown to include a water supply button 108 that preferably functions to alternately open and then close an electric solenoid valve (not shown) associated with water pipe 82. Control panel 105 also includes a drainage control button 109 that can switch the position of a valve (not shown) used to open and close drain pipe 88. Finally, control panel 105 includes a heat control button 110 used to regulate the activation of energy source 97. Although the successive pressing of control button 110 could simply switch energy source 97 between activated and deactivated positions, control button 110 could also switch energy source 97 between low, medium and high settings, as well as also providing a deactivated position. In any event, it should be readily apparent that control panel 105 can take various forms without departing from the invention. The electrical wiring associated with control panel 105 has not been shown herein since this wiring is not considered part of the present invention and can take various forms which would be readily obvious to one of ordinary skill in the art. Instead, it is important to note in accordance with the invention that sink 62 has an integrated water supply which enters basin 65 at a level below work surface 8, incorporates a drain for the water and further includes a heating source for boiling the water provided into the basin. If desired, a water level sensor or the like could be provided as part of control circuitry to mandate a prescribed level of water within basin 65 prior to enabling the activation of energy source 97.

Cooking system 60 in accordance with the invention also preferably incorporates a food container 120 which can be used in combination with sink 62 in order to cook many different types of food items, including poultry, shrimp, eggs, pasta and vegetables. In the most preferred form of the invention, container 120 takes the form of a wire mesh colander having an upper peripheral rim 128 and a body portion 130. Body portion 130 is sized and shaped to conform to basin 65 such that placing food items within container 120 while container 120 is arranged within basin 65 is substantially the same as placing the food items directly into basin 65, at least for the purpose of a given cooking operation. For convenience of removing the cooked food items, container 120 preferably incorporates a handle 138 which is adapted to extend along and preferably over a portion of countertop 6.

When the overall cooking system 60 is utilized, water is supplied within basin 65 through water pipe 82 and water inlet 80. When the water level reaches above energy source 97, energy source 97 is activated to heat the water. Once the water reaches a sufficient temperature, food items arranged in container 120 are submerged in the water for a prescribed period of time in order to cook the items. Thereafter, food container 120 can be removed from basin 65 and any water dripping from container 120 will still fall into sink 62. The food items can then be transferred to another container, platter or the like for serving purposes. Energy source 97 can be automatically de-activated through the use of a timer (not shown) or directly through control button 110.

Based on the above, sink 62 represents an additional cooking appliance associated with island 2 that can be dedicated for use in cooking food items in boiling water. The presence of boiling sink 62 can effectively free up one or more of surface heating elements 35–38 of cooktop 34 for other cooking operations. In addition, since sink 62 is provided with its own water inlet 80 and drain outlet 86, it can be readily cleaned as needed.

Although described with respect to a preferred embodiment of the invention, it should be readily understood that various changes and/or modifications can be made to the invention without departing from the spirit thereof. In general, the invention is only intended to be limited by the scope of the following claims.

We claim:

1. A kitchen cooking system comprising:

a countertop including a generally horizontal, elongated work surface;

at least one of a cooktop, including multiple surface heating zones, and a sink positioned in the countertop;

a secondary sink defining a basin recessed within the countertop;

a water inlet opening into the basin at a level below the work surface, said water inlet being adapted to supply water into the basin;

an energy source, integrated with the secondary sink, for heating water supplied into the basin, wherein food items placed in the basin can be cooked by the heated water; and an outlet provided in the secondary sink for draining the basin.

2. The cooking system according to claim 1, wherein the basin includes a floor and upstanding side walls extending from the floor towards the work surface, said water inlet being formed in one of the side walls of the basin, adjacent the work surface.

3. The cooking system according to claim 1, wherein the basin includes inner and outer surfaces, said energy source extending about a portion of the outer surface such that water supplied into the basin is heated through the basin.

4. The cooking system according to claim 3, wherein the basin includes a floor and upstanding side walls extending from the floor towards the work surface, said energy source extending along said floor and up at least a portion of the side walls.

5. The cooking system according to claim 4, wherein the energy source is constituted by at least one electric resistance heating element.

6. The cooking system according to claim 1, further comprising: a cooking container having a body shaped to conform to an interior of said basin, said cooking container being adapted to hold food items to be cooked within the secondary sink.

7. The cooking system according to claim 6, wherein the container constitutes a colander having bottom and side wall portions provided with a plurality of spaced through holes.

8. The cooking system according to claim 7, wherein the colander includes an elongated handle adapted to extend along the countertop when the container is positioned in the basin.

9. A kitchen cooking system comprising:

a countertop including a generally horizontal, elongated work surface;

at least one of a cooktop, including multiple surface heating zones, and a sink positioned in the countertop;

a secondary sink defining a basin recessed within the countertop, said basin being adapted to be supplied with water;

an energy source for heating water supplied into the basin;

an outlet for draining the basin; and a cooking container having a body sized to fit within the basin, said cooking container being adapted to be placed within the basin while housing food items in order to cook the food items within the secondary sink.

10. The cooking system according to claim 9, further comprising: a water inlet opening into and sealed to the basin at a level below the work surface.

11. The cooking system according to claim 10, wherein the basin includes a floor and upstanding side walls extending from the floor towards the work surface, said water inlet being formed in one of the side walls of the basin, adjacent the work surface.

12. The cooking system according to claim 9, wherein the basin includes inner and outer surfaces, said energy source extending about a portion of the outer surface such that water supplied into the basin is heated through the basin.

13. The cooking system according to claim 12, wherein the basin includes a floor and upstanding side walls extending from the floor towards the work surface, said energy source extending along said floor and up at least a portion of the side walls.

14. The cooking system according to claim 13, wherein the energy source is constituted by at least one electric resistance heating element.

15. The cooking system according to claim 9, wherein the container constitutes a colander having bottom and side wall portions provided with a plurality of spaced through holes.

16. The cooking system according to claim 15, wherein the colander includes an elongated handle adapted to extend along the countertop when the container is positioned in the basin.

17. The cooking system according to claim 1, wherein the secondary sink is formed integral with the countertop.

18. The cooking system according to claim 1, further comprising: a control panel, provided on the countertop, including a plurality of control elements for establishing a desired water level and temperature in the secondary sink.

19. The cooking system according to claim 9, wherein the secondary sink is formed integral with the countertop.

20. The cooking system according to claim 9, further comprising: a control panel, provided on the countertop, including a plurality of control elements for establishing a desired water level and temperature in the secondary sink.

* * * * *